United States Patent [19]

Thomas

[11] Patent Number: 4,957,207

[45] Date of Patent: Sep. 18, 1990

[54] EXTENSIBLE HOIST FOR A NATERO VESSEL

[76] Inventor: Barclay L. Thomas, 24800 Highway One, Fort Bragg, Calif. 95437

[21] Appl. No.: 308,417

[22] Filed: Feb. 9, 1989

Related U.S. Application Data

[63] Continuation of Ser. No. 145,974, Jan. 20, 1988, abandoned, which is a continuation of Ser. No. 762,720, Aug. 5, 1985, abandoned.

[51] Int. Cl.[5] ..... B66C 23/52

[52] U.S. Cl. ..... 212/192; 114/362; 188/82.74; 188/82.9; 212/231; 212/244; 212/263; 212/267

[58] Field of Search ..... 212/190–193, 212/211, 182, 223, 227, 229, 230–232, 235, 237, 239, 240, 241, 244, 255, 256, 262, 263, 264–267; 114/362; 254/321, 356–357, 391; 188/82.74, 82.9

[56] References Cited

U.S. PATENT DOCUMENTS

| | | | |
|---|---|---|---|
| 550,343 | 11/1985 | Greener | 114/374 |
| 767,817 | 8/1904 | Inman | 188/82.9 |
| 900,685 | 10/1908 | Knuppel | 212/193 |
| 984,670 | 2/1911 | Heedwell et al. | 212/230 |
| 1,611,326 | 12/1926 | Abbe | 212/267 |
| 2,555,501 | 6/1951 | Morgan | 254/391 |
| 2,571,858 | 10/1951 | Garland | 212/231 |
| 2,590,610 | 3/1952 | Grosch | 188/82.9 |
| 2,919,036 | 12/1959 | Raymond | 212/231 |
| 3,171,545 | 3/1965 | Knight et al. | 212/268 |
| 3,889,818 | 6/1975 | Wennerstrom | 212/231 |

FOREIGN PATENT DOCUMENTS

| | | | |
|---|---|---|---|
| 171491 | 10/1885 | France | 212/239 |
| 1182129 | 1/1959 | France | 212/231 |
| 504881 | 9/1956 | Italy | 114/374 |
| 656400 | 8/1951 | United Kingdom | 114/102 |
| 856536 | 12/1960 | United Kingdom | 212/190 |
| 1157781 | 7/1969 | United Kingdom | 212/190 |

*Primary Examiner*—Joseph F. Peters, Jr.
*Assistant Examiner*—R. B. Johnson
*Attorney, Agent, or Firm*—Cassidy, Vance & Tarleton

[57] ABSTRACT

A relocating apparatus having a pivot connector for removably pivotally connecting the apparatus to a mast of a sailing vessel. The relocating apparatus also includes a telescoping sleeve assembly which supports a cable which can be connected to a load such as a dinghy. The cable is retracted about a drum which is rotated by a winch handle inserted in the relocating apparatus causing the dinghy to be raised. The relocating apparatus is swung about the pivot connecter to place the dinghy into position near a deck edge of the vessel. The telescoping sleeve assembly is then retracted or extended as desired by inserting the winch handle in a second socket and rotating the winch handle in the desired direction. After the dinghy has been located above the desired position, the cable is extended by inserting the winch handle in the proper socket and rotating the handle.

5 Claims, 6 Drawing Sheets

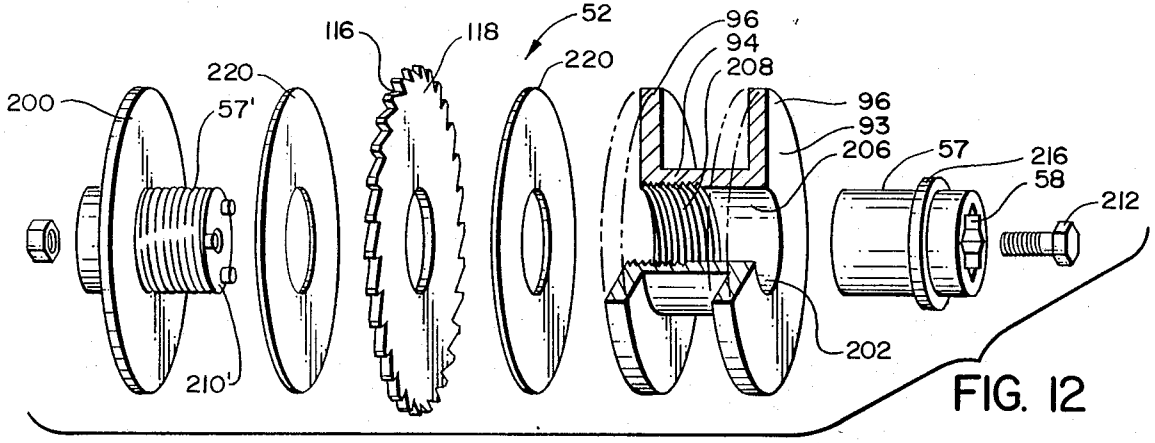
FIG. 12
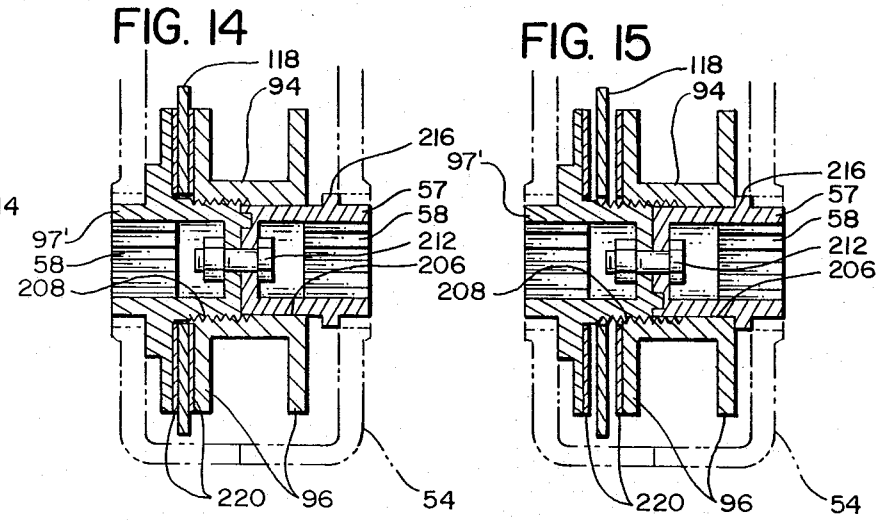
FIG. 15
FIG. 14
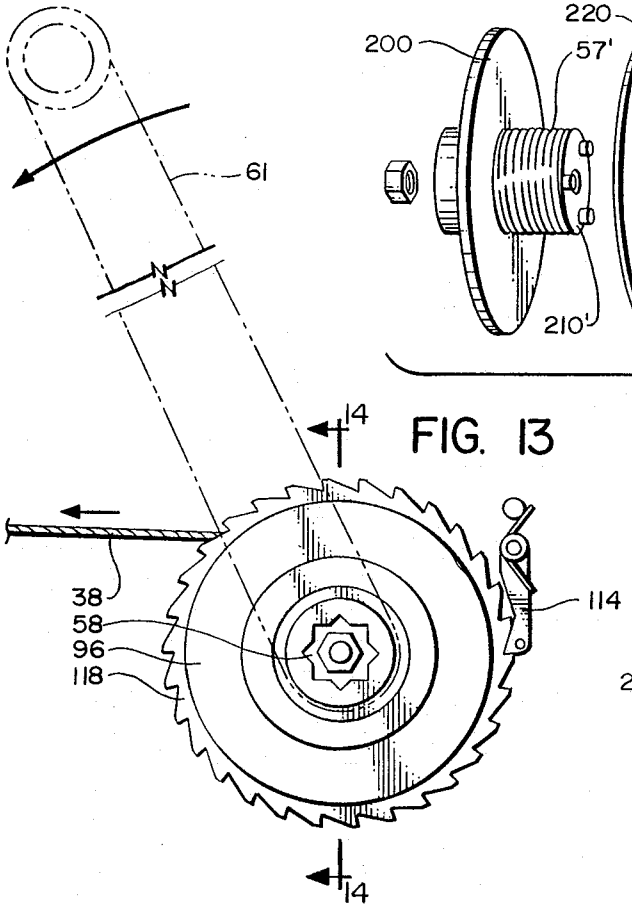
FIG. 13

EXTENSIBLE HOIST FOR A NATERO VESSEL

RELATED APPLICATIONS

This application is a continuation application based on applicant's prior co-pending U.S. application Ser. No. 145,974 filed Jan. 20, 1988, now abandoned, such prior application being, in turn, a continuation application based on applicant's prior co-pending U.S. application Ser. No. 762,720, filed Aug. 5, 1985, now abandoned.

BACKGROUND OF THE INVENTION

1. Technical Field

The present invention relates generally to apparatus and methods for moving a load from one location to another; and, more particularly, to apparatus for use aboard watercraft to: (i) raise a load, such as a small boat or dinghy; (ii) move the load to a new selected location; and (iii), lower the load at the new selected location.

2. Background Art

It is commonly known that various types of devices such as cranes and derricks are available for lifting heavy loads and transferring these loads to other locations where the loads may be deposited. Typically, these cranes are large heavy devices, often machine powered, which require large areas in which to operate and which are cumbersome to move to different job locations.

In the shipping industry, larger ships are equipped with cranes to load and off-load cargo. Smaller ships and boats not equipped with these cranes, must depend upon dock mounted cranes to accomplish heavy loading and unloading operations. Often, however, these dock mounted cranes are unavailable, particularly at smaller moorages, so that the heavy loading and unloading must be done manually.

A number of boats, however, utilize a crane-like device called a davit to raise and lower a dinghy or lifeboat between the boat and the water. The davits usually are two curved upright members which project over the side of the boat for suspending the dinghy over the water, and which allow the dinghy to be hoisted into and out of the water. The davits are typically immobile except for downwardly extending cables which are retracted and extended to raise and lower the dinghy. These davits are typically immobile except for downwardly extending cables which are retracted and extended to raise and lower the dinghy. These davits are sometimes found on some larger pleasure power boats, typically extending over the stern of the boats. Normally when a dinghy is supported by davits, the davit arms extend over the side a short distance so that the dinghy may clear the side of the boat when being raised or lowered. However, often two people are necessary to operate such devices since one person is required to operate the mechanism for raising and lowering the dinghy, while a second person must stabilize the dinghy from impacting the side of the boat during gusty winds or if the raising/lowering of the dinghy imparts a sideways motion to the dinghy.

Some power boats typically support the dinghy on a transom extending rearwardly from the stern near the water line in a manner that the dinghy is hoisted by pulling a line attached to a gunwhale of the dinghy so the dinghy may be pulled upwardly on its side to rest athwartships on the transom.

In pleasure sailing vessels, the dinghy normally is towed behind the vessel. It is undesirable to support the dinghy at the stern of the sailing vessel because the weight of the dinghy adversely affects the vessel's sailing qualities. In addition, the dinghy can fill with sea water caused by large waves coming over the deck of the sailboat making the sailboat further stern heavy and possibly unseaworthy. Therefore, a preferable location for stowing a dinghy on a sailing vessel is at a forward location along the vessel's centerline so that: (i) the trim of the sailing vessel is not adversely affected; and (ii), the dinghy is forward of waves which typically impact the deck of the sailboat at an aft location. However, when stowing the dinghy forward along the vessel's centerline, problems are often encountered since such dinghies are difficult to manipulate as they are moved between a first location resting on the sailing vessel near the centerline, and a second location outboard of the deck edge, where they can be readily lowered into the water. Davits are unsuitable for accomplishing this type of operation.

Various conventional apparatus and methods have been disclosed for raising and lowering loads from a boat or ship. In U.S. Pat. No. 3,640,400—Becraft, there is disclosed a method for retrieving a submerged hose connected to a marker buoy to bring such hose aboard ship. The method utilizes a first cable to raise the marker buoy above the deck of the ship, and then a second cable to raise a section of chain attached to the marker buoy, in a manner such that the marker buoy is lowered onto the deck of the ship, and the first cable is then removed from the marker buoy and attached to another succeeding section of chain. The second cable lowers the first section of chain to the deck, then is removed from the first section of chain, and is reattached to a third section of chain to raise the third section above the deck. This process continues until the end of the chain attached to the submerged hose together with the submerged hose are retrieved.

An apparatus for engaging a torpedo floating in the water is disclosed in U.S. Pat. No. 3,262,585 by Olson, including a plurality of poles having cables which form open nooses which are threaded around the torpedo and then tightened around the outer surface thereof so that the torpedo can be manipulated in the water. The open nooses include a fixed loop for attaching a crane hook so that the torpedo can be hoisted out of the water and onto the deck of the ship. In U.S. Pat. No. 2,196,518 to Boudreau, a davit for hoisting a load to and from the deck of a boat is disclosed wherein the davit includes a carriage assembly mounted within a fore and aft track, and a first elongated member pivotally connected to the carriage for movement to an upright position to support a cable for hoisting the load, and a second elongated member pivotally connected to the carriage and having an end sleeve slidably engaged to the first elongated member for supporting the member in the upright position.

Snelling, U.S. Pat. No. 1,125,197 discloses apparatus for lifting boats from the well of a ship, including a boom for supporting cables which are attached to the boat and which are wound about a motor driven drum to raise and lower the boats from the well.

In Sawman, U.S. Pat. No. 1,094,750 a boat davit is disclosed including an elongated boom pivotally connected to upstanding flanges to support the boom between raised and lowered positions. The boat davit also includes an actuating arm threadably engaged to an elongated worm gear for longitudinal movement along the worm gear. The actuating arm is also pivotally connected to a base so that rotation of the worm gear by a crank causes the actuating arm to move longitudinally along the worm gear causing the boom to move between the lowered and raised positions.

U.S. Pat. No. 550,343—Greener, discloses a boom, slidably and rotatably connected to the mast of a sailing ship, and having a hook at an outboard end thereof for engaging a bridle supporting a lifeboat so that when the boom is lowered by block and tackle, the boat may be lowered over the side of the ship and into the water.

SUMMARY OF THE INVENTION

The present invention comprises apparatus for relocating a load which typically is too heavy for a person to move without mechanical assistance. The apparatus is adapted to be mounted to a vertical structure of a watercraft, which includes an edge defining a perimeter of the watercraft, in order to relocate the load between the watercraft and a location outside the perimeter of the watercraft. The apparatus comprises a support beam located upwardly from the load and having a first end portion connected to the vertical structure in a manner to permit the support beam to be moved laterally. The support beam includes a second end portion spaced apart from the vertical structure a distance greater than the distance from the vertical structure to the edge of the watercraft so that the lateral movement causes the second end portion and any load carried thereby to be moved between a first location within the perimeter of the watercraft and a second location where the second end portion and the load are positioned outside the perimeter of the watercraft. The apparatus also includes means for moving the load in both a generally upward direction and a generally downward direction. The moving means includes a cable operatively connected to the support beam at the second end portion thereof and having an end adapted to be connected to the load. The moving means also includes means for retracting the cable to cause the load to move in an upward direction, and for extending the cable to cause the load to move in a downward direction.

In an exemplary embodiment, the second end portion is movably engaged to the first end portion in a manner to allow the second end portion to be repositioned along a longitudinal axis of the support beam in a first direction toward the first end portion, and in a second direction away from the first end portion. The support beam includes a first crank operatively connected to the second end portion and adapted for manual engagement to move the second end portion in the first and second directions. The first end portion of the support beam is releasably fastened to the vertical structure about an axis generally parallel to the vertical structure to permit the support beam to be pivoted manually about the vertical structure.

In another exemplary embodiment, the load comprises a small boat or dinghy which is normally stowed at a forward location along a fore and aft centerline of the watercraft—i.e., a sailboat. The present invention discloses apparatus for relocating the dinghy between the forward centerline location and a location outward from and below a deck of the sailboat—e.g., in a body of water.

In the present invention, the second end portion includes a first sleeve coaxially aligned within the first end portion for axial slidable movement therein. A first crank is operatively connected to the first sleeve and adapted to be manually engaged to move the first sleeve in the first and second directions. The second end portion also includes a second sleeve coaxially aligned within the first sleeve for axial slidable movement therein. The second sleeve is releasably engaged to the first sleeve at selected axial locations to permit selective manual axial repositioning of the second sleeve in the first and second directions.

The cable retraction and extension means include a drum rotatably engaged to the support beam to wind the cable in a winding direction thereon in order to retract the cable, and to unwind the cable therefrom in an unwinding direction in order to extend the cable. A second crank operatively connected to the drum is adapted to be engaged by the operator to wind and unwind the cable from the drum.

The cable extension and retraction means may also include a first roller having an outer portion which rotatably engages an outer portion of the drum in a manner that rotation of the drum in a first direction causes the roller to rotate in an opposite direction therefrom. A second roller having an outer portion which engages the cable urges the cable against the first roller. The first roller and the drum are characterized in that the distance from an axis of rotation of the first roller to the outer portion thereof is greater than the distance from an axis of rotation of the drum to the cable wound upon the drum, thus causing the first roller to pull the cable from the drum when the drum is rotated in the unwinding direction.

The cable retraction and extension means include a flange member freely rotatable in the winding direction, and restricted from rotation in the unwinding direction. The flange member is movable by manual rotation of the second crank between a first position wherein the drum rotates independently of the flange member, and a second position wherein the drum is engaged to the flange member so that the drum is restricted from rotation in the unwinding direction.

The present invention also includes a method for relocating a load to and from a watercraft having a vertical support position and an edge defining a perimeter of the watercraft. The method includes the steps of providing a support beam having a first end portion connected to the vertical support portion in a manner to permit the support beam to be moved laterally with respect to the watercraft, and a second end portion spaced apart from the first end portion to define a distance between the vertical support portion and the second end portion which is greater than the distance between the vertical support portion and the edge of the watercraft. The method also includes the step of attaching a cable (which is operatively connected to the support beam at the second end thereof) to the load, and retracting the cable to raise the load toward the support beam. The support beam is moved laterally between a first position where the second end of the support beam is positioned above the watercraft, and a second position where the second end of the support beam is positioned outside the perimeter of the watercraft so as to move the load between a first location above the watercraft and a second location beyond the watercraft perimeter. The cable is extended to lower the load away from the support beam. The method also comprises moving the second end portion coaxially with respect to the first end portion so that in cooperation with the step of moving the support beam laterally, the second end portion is moved between the first position and the second position.

The present invention comprises, in another exemplary embodiment, a portable apparatus for mounting to a vertical structure in order to relocate a load. The apparatus comprises a support beam located upwardly from the load and having a first end portion releasably fastened to the vertical structure in a manner to permit the support beam to be moved laterally. The support beam includes a second end portion operatively connected to the first end portion and repositionable along a longitudinal axis of the support beam in a first direction away from the first end portion and in a second direction toward the first end portion. Means are provided for repositioning the second end portion along the longitudinal axis. Means are also included for moving the load in both a generally upward and a generally downward direction. The moving means include a cable operatively connected to the movable end portion and which is adapted to be connected to the load. Means retract the cable to cause the load to move in the upward direction, and extend the cable to cause the load to move in the downward direction, whereby the repositioning means and the retracting and extending means are adapted to be manually operated to raise the load from a first location, to move the load longitudinally and laterally, and to lower the load at a second location.

In another exemplary embodiment, there is provided a method for relocating a load, such as a dinghy, about a watercraft having a vertical support portion and an edge defining a perimeter of the watercraft. The method includes the steps of providing a support beam having a first end portion connected to a vertically extending mast of the watercraft in a manner to permit the support beam to be moved in a lateral direction, and providing a second end portion spaced apart from the first end portion. A cable which is operatively connected to the support beam at the second end thereof is attached to the load. The cable is retracted to raise the load toward the support beam from a location within the perimeter of the watercraft. The support beam is moved in a lateral direction and the second end portion is moved axially away from the first end portion so that in cooperation with moving the support beam in the lateral direction, the second end portion of the support beam is positioned beyond the watercraft edge outside the perimeter thereof so as to move the load between a first location within the watercraft perimeter and a second location outward from the watercraft perimeter. The cable is extended to lower the load to a location outward from and below the watercraft edge.

The method also comprises retracting the cable to raise the load to the second location and moving the support beam laterally toward the first location. The second end portion is moved axially toward the first end portion so that in cooperation with moving the support beam laterally toward the first location, the second end portion of the support beam is positioned above the watercraft so as to move the load from a location outward from the watercraft perimeter to a location above the watercraft. The cable is extended to lower the load to the location within the perimeter of the watercraft.

BRIEF DESCRIPTION OF THE DRAWINGS

These and other objects of the present invention will become more readily apparent upon reading the following detailed description and upon reference to the attached drawings, in which:

FIG. 12 is an exploded view of cable extension and retraction means showing a drum for winding cable thereabout and a ratchet disk;

FIG. 13 is a side view of the cable extension and retraction means showing a pawl for engaging the ratchet disk and a winch handle for manually operating the cable extension and retraction means;

FIG. 14 is an end sectional view of the cable extension and retraction means, taken substantially along the line 14—14 of FIG. 13, wherein the ratchet and drum are in a non-freewheeling mode;

FIG. 15 is an end sectional view taken substantially along the same line as FIG. 14 wherein the drum is in a freewheeling mode.

Figure 1:
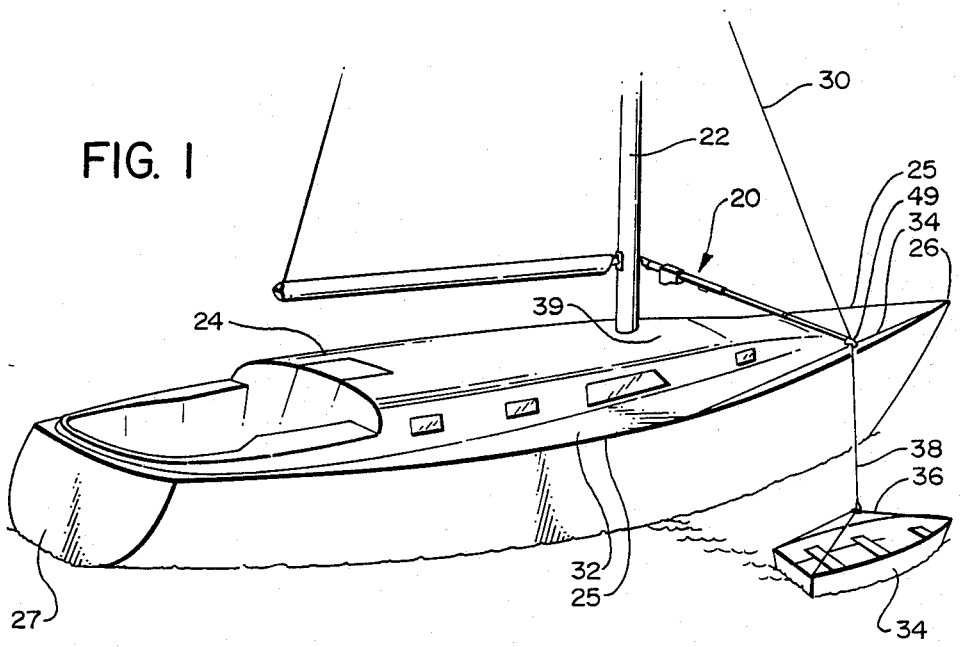
FIG. 1 is an isometric view of an exemplary embodiment of the present invention, showing an exemplary relocating apparatus engaged to the main mast of a sailing vessel wherein the relocating apparatus is used to raise and lower dinghy over the side of the vessel.

While the present invention is susceptible of various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents and/or alternatives falling within the spirit and scope of the invention as expressed in the appended claims.

DESCRIPTION OF THE INVENTION

Figure 2:
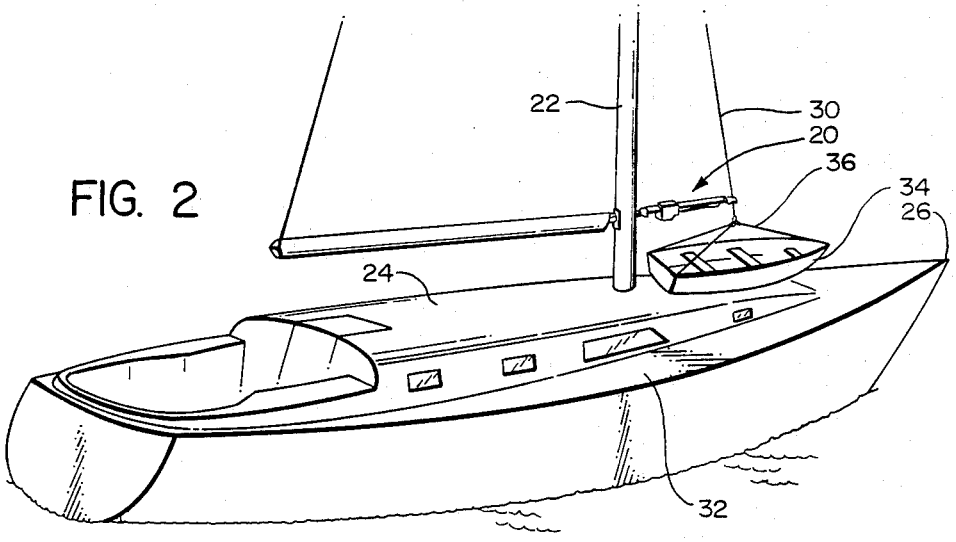
FIG. 2 is an isometric view, similar to the view of FIG. 1, wherein the relocating apparatus is engaged to the dinghy which is stowed at a preferred location on the sailing vessel along the vessel's centerline in a forward location above a cabin overhead.

Referring to FIGS. 1 and 2, the apparatus and methods of the present invention will be disclosed in an exemplary embodiment wherein a dinghy is relocated between: (i) a stowed position onboard a sailboat; and (ii), the water. It should be understood, however, that the present invention is not limited to relocating a dinghy to and from a sailboat, but rather it may be utilized whenever it is desired to move a relatively heavy load between two locations.

In FIGS. 1 and 2, there is shown a relocating apparatus, generally indicated at 20, having an elongate configuration, removably and pivotally connected to a forward surface of a main mast 22 extending vertically from a sailing vessel 24. The exemplary relocating apparatus 20 is connected to main mast 22 in a manner to permit the relocating apparatus 20 to swing outboard of deck side edges 25 which extend aft from bow 26 terminating at stern 27; with the bow 26, deck edges 25 and stern 27 defining a perimeter of sailing vessel 24. The relocating apparatus 20 includes a shackle 28 (FIG. 4) pivotally connected to the relocating apparatus 20 at a distal end thereof for engaging a mainsail halyard 30 depending downwardly from a top portion of main mast 22 to support the relocating apparatus 20 at a level generally parallel to a main deck 32 of sailing vessel 24. In the present application the term "outward" will be used to describe a direction generally away from mast 22, whereas the term "inward" will be used to describe a direction generally toward mast 22.

To prevent the relocating apparatus 20 from pivoting in a fore and aft direction when pivoted outboard to the position shown in FIG. 1, additional lines 33 are connected to shackle 28 and to conventional cleats (not shown) anchored to deck 32 located generally fore and aft of main mast 22. A dinghy 34 is moved by a cable 38 which is retracted by relocating means 20 to raise dinghy 34, and which is extended from relocating means 20 to lower dinghy 34. The dinghy 34 typically includes a bridle 36 attached to the bow and stern of the dinghy 34 to support the dinghy in a generally level attitude during its relocation. As shown in FIG. 2, it is preferable to stow dinghy 34 aboard the sailing vessel 24 at a forward centerline location thereof to avoid upsetting the trim of sailboat 24 as well as to avoid filling the dinghy 34 with sea water which may be received in large waves over the bow of sailboat 24 and which typically impact deck 32 and inner areas of the sailboat 24 aft of main mast 22.

When it is desired to remove dinghy 34 from sailboat 24, the relocating apparatus 20 is removed from its stowed location aboard sailboat 24, typically below deck or within the stowed dinghy, and attached to the main mast 22 and to the main sail halyard 30. After attaching cable 38 to bridle 36, the operator then retracts cable 38, thereby elevating dinghy 34 above cabin overhead 39. The operator then pivots relocating apparatus 20 outboard so that dinghy 34 is suspended outward from deck edge 25 at a location over the water. In the event that dinghy 34 does not clear deck edge 25, and to provide additional clearance between deck edge 25 and dinghy 34 so that an additional operator need not be present to insure that dinghy 34 does not impact the side of sailboat 24, the operator extends the relocating apparatus 20 longitudinally outward until dinghy 34 is well clear of the perimeter of sailing vessel 24. Cable 38 is then extended in order to lower dinghy 34 into the water at a location shown in FIG. 1. Retrieval of dinghy 34 is accomplished in reverse order of the aforementioned steps. When the operator is finished, support lines 33 and main sail halyard 30 are disengaged, and the relocating apparatus is removed from mast 22 and returned to its stowed location. Further discussion of relocating apparatus 20 will follow hereinafter, however it should be appreciated that the exemplary relocating apparatus 20 of the present invention allows a dinghy 34 to be relocated, as described above, by one operator without the assistance of additional operators to stabilize the dinghy 34 or to prevent the dinghy 34 from impacting the side of the sailboat 24.

Figures 3, 4, 5, 6:
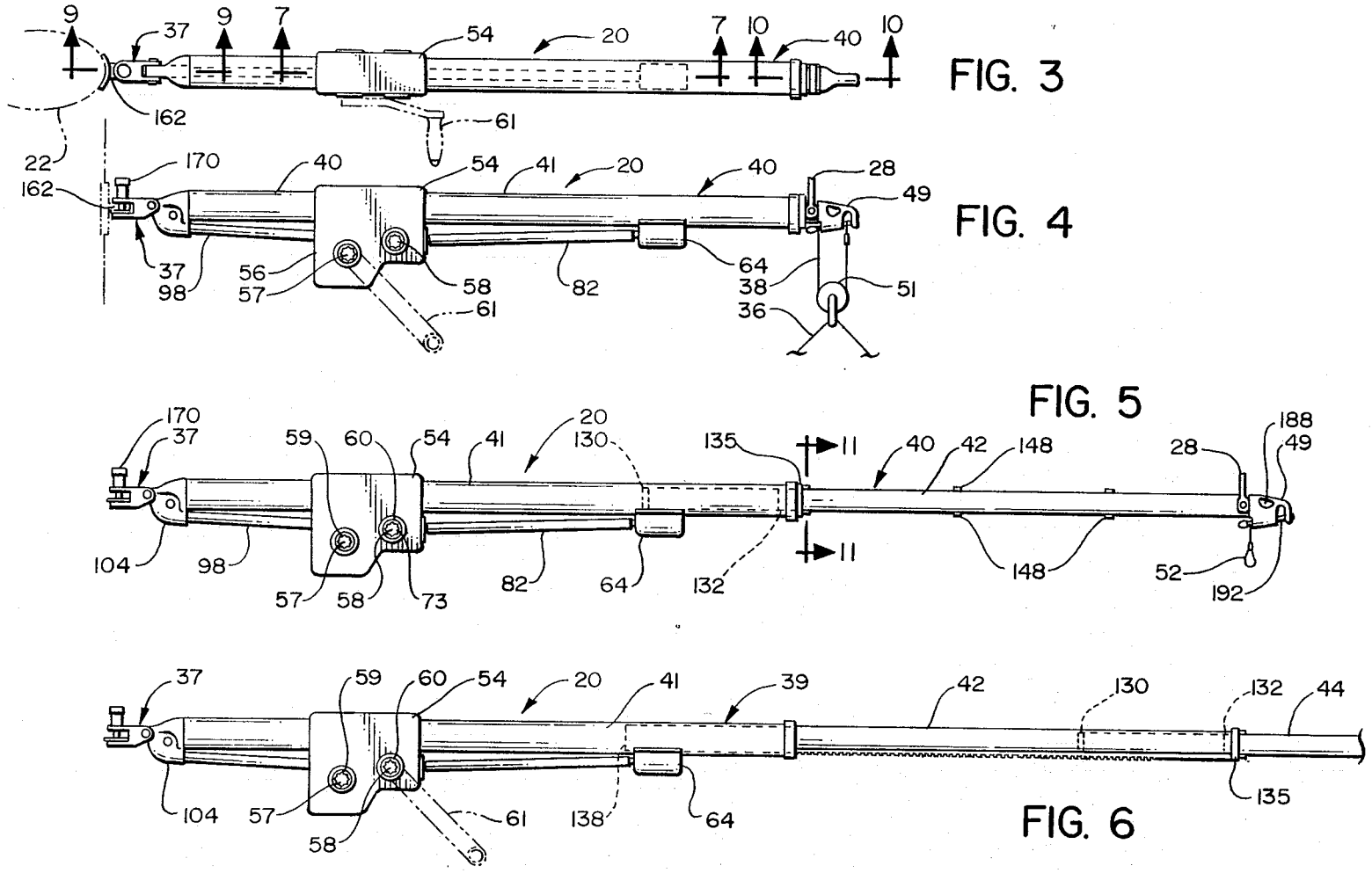
FIG. 3 is a top view of the relocating apparatus of the present invention showing a telescoping sleeve assembly in a "retracted" position.
FIG. 4 is a side view of the relocating apparatus of the present invention showing the telescoping sleeve assembly in the "retracted" position.
FIG. 5 is a side view of the relocating apparatus showing the telescoping sleeve assembly in an "intermediate extended" configuration.
FIG. 6 is a fragmentary side view of the relocating apparatus showing the telescoping sleeve assembly in a "fully extended" configuration, and wherein an end portion of the sleeve assembly is not shown for ease in illustrating the relocating apparatus.

Referring now to FIGS. 3 through 6, it will be noted that the exemplary relocating apparatus 20 includes engaging means, generally indicated at 37 for pivotally removably connecting relocating apparatus 20 to mast 22. The relocating apparatus 20 also includes a telescoping sleeve assembly, generally indicated at 40, for supporting a dinghy 34 by means of cable 38. As here shown, the telescoping sleeve assembly 40 includes an outer cylindrical sleeve 41 enclosing an intermediate cylindrical sleeve 42 which is coaxially aligned within outer sleeve 41 and which is movable axially between a "retracted" position enclosed within sleeve 41 as shown in FIGS. 3 and 4, and an "extended" position outward and away from connecting means, generally indicated at 39 in FIG. 6. The telescoping assembly 40 also includes an inner cylindrical sleeve 44 enclosed coaxially within intermediate sleeve 42 and movable axially with respect to sleeve 42 from a "retracted" position enclosed within sleeve 42, as shown in FIG. 5, and an "extended" position outward from engaging means, generally indicated at FIG. 6.

As described previously, the illustrative relocating apparatus 20 is supported by main sail halyard 30 which is connected to shackle 28 pivotally connected to sleeve 44 at a distal end thereof. Located outward from shackle 28 is a fitting 49 for engaging a loop 52 at the distal end of cable 38, shown in FIG. 5. Typically dinghy lift bridle 36 includes a pulley 51 (FIG. 4). Cable 38 extends downward about pulley 51 and then upward where it is engaged by fitting 49. This arrangement results in a two-fold purchase which reduces the manual effort of raising and lowering the load. Cable 38 is extended and retracted by retraction and extension means, generally indicated at 52 in FIG. 7, enclosed within a housing 54 which is attached to outer cylindrical sleeve 41. Housing 54 includes a pair of oppositely disposed vertical side members 56 which support a pair of rotatable drive shafts 57, 58 mounted perpendicular to side members 56 and having axially recessed sockets 59, 60, respectively, located at opposite ends of shafts 57, 58. Sockets 59, 60 are adapted to engage the male end of a universal winch handle 61 (FIGS. 4 and 6) to impart rotational movement to drive shafts 57, 58 such that rotation of drive shaft 57 in opposite directions serves to retract or extend cable 38; while rotation of drive shaft 58 serves to retract or extend telescoping sleeve 42 in the manner described herebelow. Telescoping sleeve 44 is retracted and extended by manually moving sleeve 44 axially relative to sleeve 42 in a manner also described hereinbelow.

Figure 7:
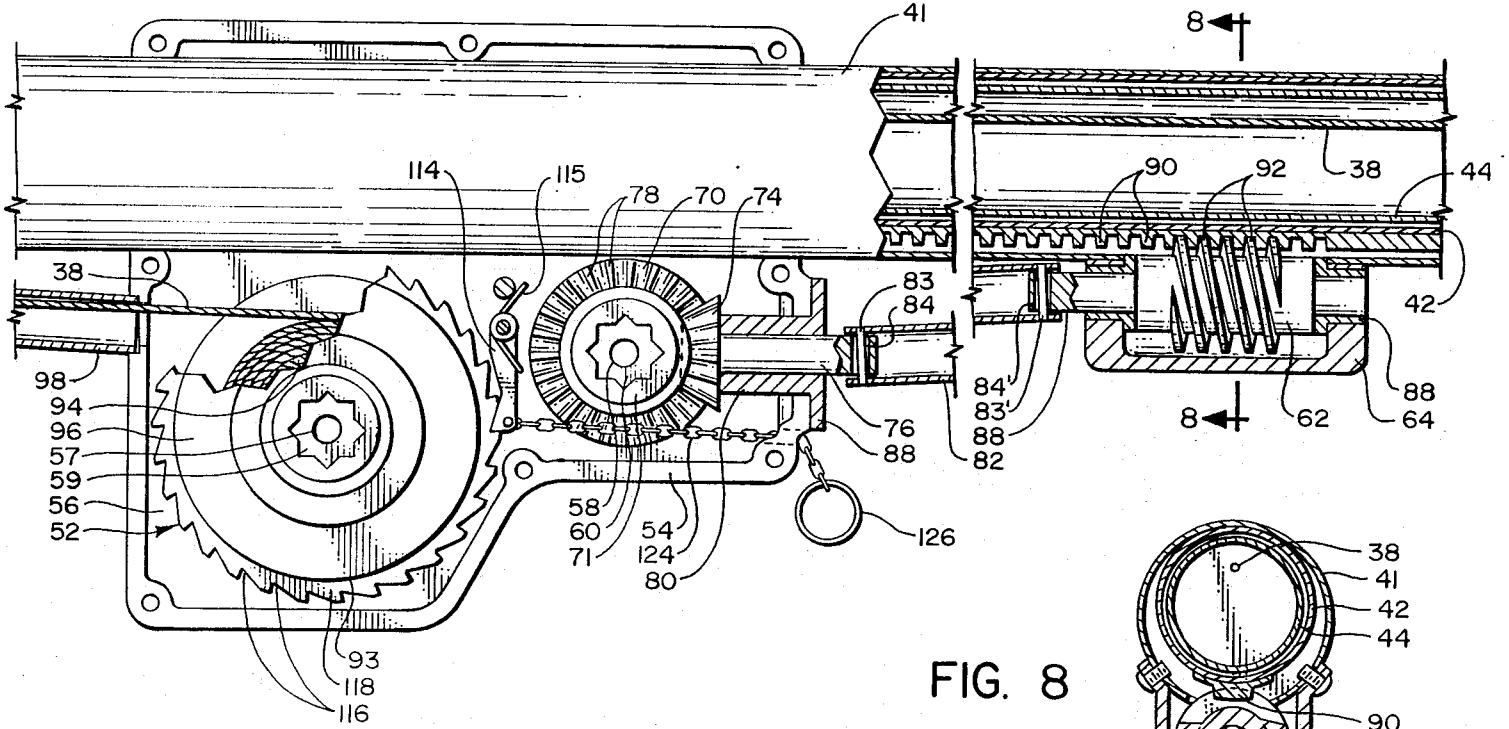
FIG. 7 is a side sectional view of a portion of the relocating apparatus, taken substantially along the line 7—7 in FIG. 3, showing a circular rack, a bevelled gear, and a worm gear for driving the telescoping sleeve assembly between the "extended" and "retracted" configurations, and also showing a cable drum for extending and retracting a cable.
Figure 8:
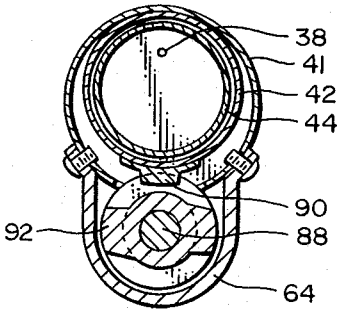
FIG. 8 is a sectional end view of the relocating apparatus, taken substantially along the line 8—8 of FIG. 7, showing the inner, intermediate, and outer sleeves of the telescoping assembly.

Referring to FIGS. 7 and 8, telescoping sleeve 42 is extended and retracted by a worm gear 62 (FIG. 7) enclosed within a rectangularly shaped housing 64 depending downwardly from cylindrical sleeve 41 at a location outward from housing 54. Side portions 56 of housing 54 are secured in opposing mating engagement around sleeve 41 by removable fasteners (not shown) to form an enclosed inner chamber containing a circular rack 70 rigidly engaged to the drive shaft 58 extending axially therethrough so that rotation of circular rack 70 by winch handle 61 rotates worm gear 62.

Rotation of worm gear 62 is accomplished by a bevelled pinion gear 74 mounted on a shaft 76 which meshes with teeth 78 of rack 70. Shaft 76, located parallel to and below sleeve 41, is supported within a shaft sleeve 80 extending in an outward direction through an opening in housing 54. The diameter of circular rack 70 causes shaft 76 to be located at a greater distance below sleeve 41 than the distance from sleeve 41 to worm gear 62 resulting in misalignment of the shaft 76 and worm gear 62. Therefore, in order to connect shaft 76 with worm gear 62, shaft 76 is coupled to a shaft sleeve 82 having a pin 83 extending vertically across an inner passageway of sleeve 82. Pin 83 is disposed vertically through a passageway 84, having a larger diameter than pin 83, and extending vertically through a distal end of shaft 76 so that pin 83 can be displaced from an imaginary axial centerline of passageway 84 to permit sleeve 82 to connect with a shaft 88 extending axially inwardly from worm gear 62. Sleeve 82 includes a second pin 83' at an opposite end thereof disposed in a second vertical passageway 84' of shaft 88 and having a greater diameter than pin 83'. Worm gear 62 is joined to shaft 88 within housing 64 at a location below outer sleeve 41. Worm gear 62 includes helically configured flights 92 which extend radially upwardly through an axially extending opening in the lower surface of outer sleeve 41 to engage and mesh with teeth 90 extending axially along intermediate sleeve 42 at a lower surface thereof. Therefore, clockwise rotation of circular rack 70, as viewed in FIG. 7, causes shaft 76 and worm gear 62 to rotate in a counterclockwise direction as viewed in FIG. 8, thus causing sleeve 42 to move in an outward, or left to right direction, as viewed in FIG. 7. Counterclockwise rotation of circular rack 70 causes sleeve 42 to be moved in an inward, right to left direction. Also enclosed within housing 54 are cable retraction and extension means 52 which include a drum 93 having a cylindrical hub 94 with integral upstanding circular flanges 96 disposed at opposite ends of hub 94 so that cable 38 may be wound around hub 94 between flanges 96. Hub 94 is rotatably mounted to shaft 57 and is located generally inward and downward from rack 70 due to the relatively large diameter of flanges 96.

Cable 38 is routed in a direction generally inward from hub 94 through an opening in housing 54 and then through a cylindrical tube 98 extending parallel to and generally below sleeve 41. Cable 38 is then routed upward and generally outward around an inward support pulley 100 (FIG. 9) which is supported for rotational movement about a shaft 102 located generally parallel to hub shaft 57 and supported at opposite ends by a rounded cap 104 attached to the inward end of sleeve 41. Cable 38 extends outwardly through sleeves 41, 42, and 44, and around an outward support pulley 108 (FIG. 10) supported for rotational movement on a shaft 110 which is supported laterally within sleeve 44 in a direction generally parallel to pulley support shaft 102. Cable 38 extends around pulley 108 then downwardly through an opening in the lower surface of sleeve 44.

Returning to FIG. 7, extension and retraction means 52 is prevented from unwanted extension by a pawl 114 which is biased by a spring 115 into engagement with recesses 116 disposed about the outer circumference of a circular ratchet 118 which is, in turn, supported for rotational movement. When pawl 114 is engaged within recesses 116, hub 94 is prevented from rotating in a counterclockwise direction as viewed in FIG. 7, so that cable 38 is prevented from extending. However, movement of hub 94 in a clockwise direction, is permitted as pawl 114 merely rides across the outer circumferential surface of ratchet 188, thereby allowing the cable 38 to be retracted. Pawl 114 can be rapidly disengaged from ratchet disk 118 by means of a chain 124 extending outwardly through housing 54 and terminating in a ring 126 which can be advantageously engaged to relocate pawl 114 in a direction generally outward and away from ratchet disk 118.

Figure 9:
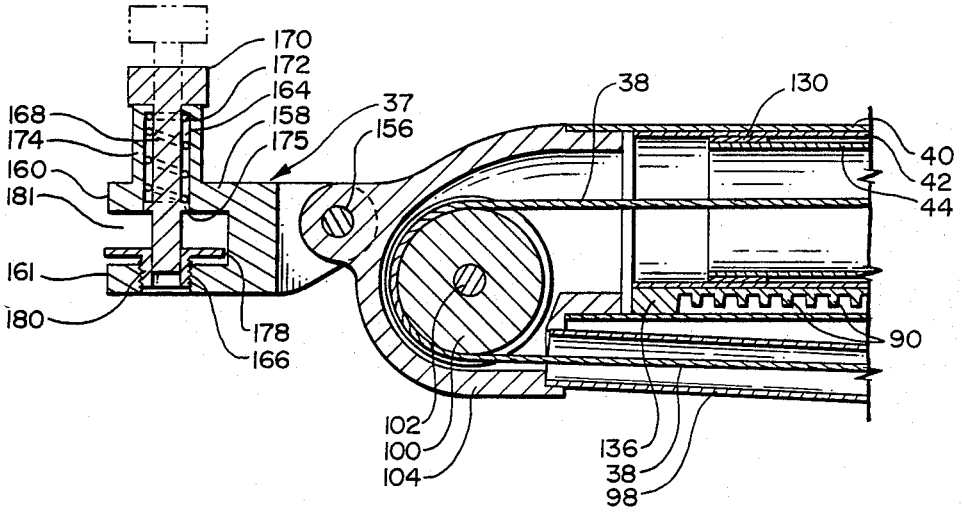
FIG. 9 is a side sectional view of an inward portion of the relocating apparatus, taken substantially along the line 9—9 of FIG. 3, showing a cable inward support roller, and mast engaging means.

Referring now to FIG. 9 in more detail, inner sleeve 44 includes a cylindrical collar 130, around an outer surface thereof at the inward end of sleeve 44 which engages an inner surface of intermediate sleeve 42 for slidable movement thereagainst. Sleeve 44 includes a second cylindrical collar 132 (FIG. 5) around an outer surface thereof located outward from collar 130 which engages the inner surface of intermediate sleeve 42 for slidable axial movement thereagainst. Collars 130, 132 support inner sleeve 44 within intermediate sleeve 42. In addition collar 132 limits outward extension of sleeve 44 by engaging a cylindrical collar 135 (FIG. 10) extending circumferentially about the outer surface of sleeve 42 at the outward end of sleeve 42. Collar 135 includes a circular lip 136 which engages the outer surface of inner sleeve 44 for slidable movement thereagainst so that at maximum outward extension of sleeve 44, inner collar 132 engages lip 136.

On the other hand, intermediate sleeve 42 is supported between the inner surface of outer sleeve 41 and flights 92 of worm gear 62 (FIG. 8). Intermediate sleeve 42 includes a flange 136, (FIG. 9), depending downwardly from the outer surface of intermediate sleeve 42 at a location inward of teeth 90, which slidably engages the inner surface of outer sleeve 41. Further outward extension of sleeve 42 is restricted when flange 136 engages the inwardmost flight 92 of worm gear 62.

Figure 11:
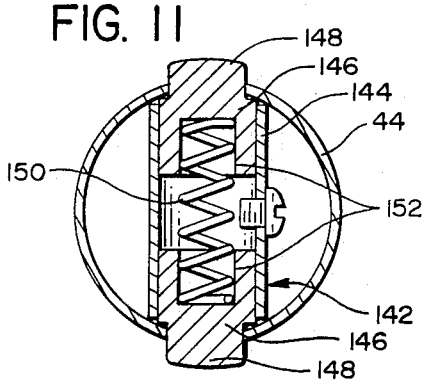
FIG. 11 is an end sectional view of the exemplary relocating apparatus of the present invention, taken substantially along the line 11—11 of FIG. 5, showing means for engaging the inner sleeve of the telescoping sleeve assembly at selected locations along the intermediate sleeve.

Selective extension and retraction of sleeve 44 is controlled by a plurality of locking assemblies, one of which is generally indicated at 142 in FIG. 11, which are disposed axially within sleeve 44. Locking assemblies 142 include opposing parallel vertical flanges 144 which engage therebetween opposing buttons 146 having tips 148 which are biased by spring 150 to extend vertically through openings in the top and bottom of sleeves 44. Spring 150 is mounted within opposed U-shaped recesses 152 of buttons 146 to urge buttons 146 in opposite vertical directions. Tips 148 extend through opposing vertical openings located axially along intermediate sleeve 42 at selected locations to secure sleeve 44 to sleeve 42 at those selected locations. When it is desired to reposition sleeve 44 relative to sleeve 42, tips 148 are compressed against spring 150 and sleeve 44 is moved axially within sleeve 42 until buttons 146 engage another pair of opposed vertical openings within intermediate sleeve 42.

In order to allow the exemplary relocating apparatus 20 of the present invention to pivot between a temporary storage location parallel to mast 22 and an operable location generally parallel to the deck of sailing vessel 24, and as best observed by reference to FIGS. 3 and 9 conjointly, the end cap 104 at the innermost end of the relocating apparatus 20 is pivotally connected to engaging means 37 by a pivot connector 156 having a pivot axis occupying a generally horizontal plane. Engaging means 37 includes a U-shaped member 158 extending inwardly from pivot connecter 156 and defined by parallel upper, lower horizontal flanges 160, 161 which receive therebetween a mast flange fitting 162 (FIG. 4) extending forwardly from mast 22 and occupying a generally horizontal plane. Flange 162 includes a vertical opening which aligns with upper and lower openings 164, 166 extending vertically through upper and lower members 160, 161 respectively. The aligned openings receive a vertical shaft 168 of a T-shaped plunger 170 therethrough to pivotally connect U-shaped member 158 to flange 162 to permit relocating apparatus 20 to pivot about an axis generally parallel to mast 22. Plunger 170 may be lifted to a "raised" position, shown in phantom in FIG. 9, against the bias of a spring 172 extending helically about shaft 168 and within a recess of a housing portion 174 which extends vertically upward from uppermost flange 160. Spring 172 is held within housing portion 174 by a collar 175 extending radially from shaft 168. The biasing action of spring 172 holds plunger 170 in an "engaging" position, shown by solid lines in FIG. 9.

Typically, the vertical thickness of flange 162 will vary. It is preferable, however, that U-shaped member 158 closely engage flange 162 to restrain movement of the relocating apparatus 20 about its longitudinal axis. Therefore, engaging means 37 includes a thumb wheel 178 integrally connected to a downwardly extending, annular, externally threaded portion 180, which is threadably engaged with threaded bore 166. Thus, the thumb wheel 178 is located between flanges 160, 161 so that an opening 181, defined by the lower surface of upper flange 160, and the upper surface of thumb wheel 178, has a variable vertical dimension to conform to the vertical thickness of flange 162. Thumb wheel 178 and annular portion 180 include a recessed area extending downwardly therethrough for slidably receiving shaft 168 when shaft 168 is in the "engaged" position. The arrangement is such that rotation of thumb wheel 178 causes vertical movement of annular portion 180 within vertical opening 166 to vary the vertical dimension of opening 181. In addition, to maintain the desired vertical dimension of opening 181, lowermost flange 161 may include a threaded set screw (not shown) which can be rotated into engagement with annular portion 180 after the desired vertical dimension of opening 181 has been achieved, thus locking the parts together.

Figure 10:
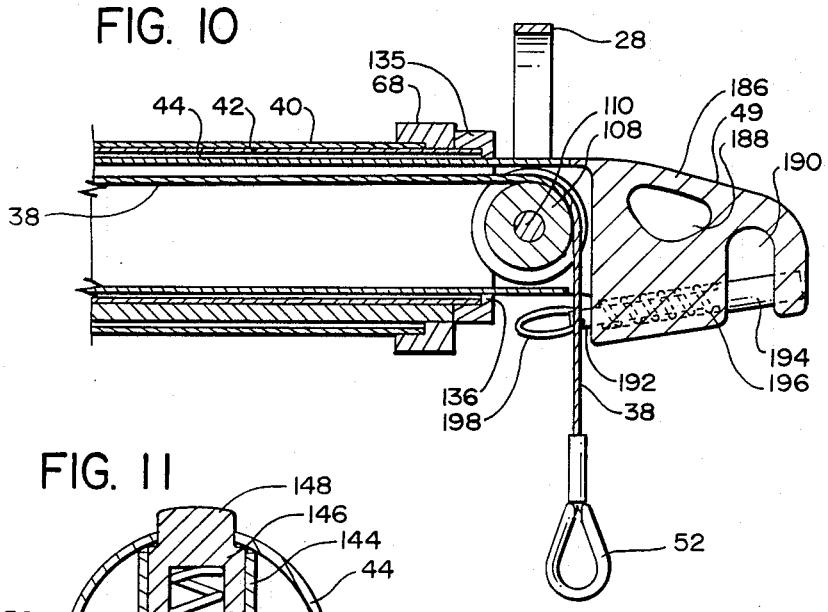
FIG. 10 is a side sectional view of an outward portion of the relocating apparatus, taken substantially along the line 10—10 of FIG. 3, showing a cable outward support roller and cable engaging means.

Referring to FIG. 10, it will be noted that the relocating apparatus 20 includes a fitting 49 having an opening 188 extending therethrough in a direction generally parallel to pulley shaft 110. Opening 188 is adapted for receiving support lines 33 (FIGS. 1 and 2) therethrough to support relocating apparatus 20 as described previously. Fitting 49 includes a U-shaped recess 190 which extends upwardly into fitting 49. Slidably engaged within fitting 49 is a spring lock 192 having a shaft portion 194 which is biased by a spring 196 across recess 194 which is biased by a spring 196 across recess 194 to engage loop 52 of cable 38 therewithin. Spring lock 192 includes an inwardly extending ring 198 attached to shaft 194 for advantageous engagement by boat hook or the like to retract shaft 194 inwardly from recess 190 against spring 196 *to allow loop 52 engaged and/or disengaged.

As discussed previously, the illustrative retraction and extension means generally indicated at 52 in FIG. 7 includes a drum 93 around which cable 38 is wound during retraction thereof. It was also discussed that extension of cable 38 was selectively prevented by an interlocking pawl 114 which engaged ratchet disk 118. Referring to FIGS. 12 through 15, in order to bypass the braking effect of pawl 114 and to allow cable 38 to be extended by an operator in a controlled manner while a load is attached thereto, ratchet disk 118 may be disengaged from drum 93 by a clutching arrangement to be described hereinafter. The clutching arrangement operates in the following manner: when winch handle 61 (FIGS. 4, 6, and 13) is rotated in a clockwise direction as viewed in FIG. 13—for example, when an operator is raising dinghy 34—drum 93 is bound into frictional engagement with ratchet disk 118 by a clutch disk 200 so as to sandwich ratchet disk 118 between drum 93 and clutch disk 200. Thus, when rotation of drum 93 is discontinued by the operator, drum 93 is prevented from rotating in a cable unwinding direction by pawl 114 which is biased into engagement with ratchet disk 118. On the other hand, when winch handle 61 is rotated by the operator in a counterclockwise direction—for example, when the cable 38 is being extended—drum 93 is released from ratchet disk 118 and clutch disc 200 so that drum 93 rotates freely. However, if rotation of winch handle 61 is stopped by the operator, and cable 38 continues to be extended by the weight of the load attached thereto, the resulting counterclockwise rotation of drum 93 again sandwiches ratchet disk 118 between drum 93 and clutch disk 200 located at the other side of ratchet 118 so a to prevent further extension of cable 38.

Further description of the clutching operation is provided by referring to FIGS. 12, 14 and 15 which show hub 94 of drum 93 having a cylindrical inner surface which defines a cylindrical bore 202. An axial portion 206 of bore 202 is relatively smooth for receiving shaft 57 therein to permit rotation of drum 93 about shaft 57. A remaining axial portion 208 of bore 202 is threaded for engaging a threaded portion of an annular shaft 57' therein. Annular shaft 57' extends through clutch disk 200 in rigid engagement therewith and includes an end surface 210' which is held rigidly in mating engagement with a like end surface (not shown) of annular shaft 57 by a fastener 212 so that shafts 57 and 57' are engaged in axial alignment. Shaft 57' includes an axially recessed socket (not shown) for receiving winch handle 61 therein. Fastener 212 includes a threaded bolt extending axially through shafts 57, 57' and the respective end surfaces thereof and which is secured by a threaded nut 213 to engage the end surfaces therebetween.

Shafts 57, 57' are rotatably supported for rotational movement by side members 56 of housing 54. Rotatably mounted to shaft 57' between clutch disk 200 and drum 93, are a pair of circular frictional disks 220 which are mounted on either side of ratchet disk 118 about shaft 57'. Therefore, in operation, clockwise rotation of winch handle 61 (FIG. 13) causes shafts 57, 57' to rotate within drum inner surface 202 causing threaded shaft 57' and clutch disk 200 integrally connected thereto to move axially in a rightward direction (FIG. 12) towards drum 93 so that friction disks 220 and ratchet disk 118 are frictionally engaged between drum 93 and clutch disk 200 causing drum 93, clutch disk 200, friction disks 220, and ratchet disk 118 to rotate in unison so that the cable 38 is retracted. Conversely, counterclockwise rotation of handle 61 by the operator causes clutch disk 200 to move in a leftward axial direction away from drum 93 to a location shown in FIG. 15, so that drum 93 and friction disks 220 may freewheel about shafts 57, 57'. The resulting disengagement of drum 93 from ratchet 118 allows the cable 38 to be extended from drum 93 as a result of the pulling force generated by the weight of dinghy 34 thereby causing drum 93 to rotate in a counterclockwise direction.

As long as the winch handle 61 is rotated by the operator at a sufficient rate in the counterclockwise direction to maintain the axially spaced relationship of ratchet 118, drum 93 and clutch disk 200 as shown in FIG. 15, drum 93 will continue to freewheel as cable 38 is being extended. Normally, however, the weight of dinghy 34 will cause drum 93 to rotate at a much faster rate than the winch handle 61 can be manually rotated. Therefore, drum 93 will rotate in a counterclockwise direction relative to shaft 57' causing drum 93 to move axially towards clutch plate 200, or to the "engaged" position shown in FIG. 14 where further rotation of cable 38 is halted by the engagement of pawl 114 against ratchet disk 118. As the winch handle 61 continues to be manually rotated in a counterclockwise direction, clutch disk 200 will once again be rotated axially to a "disengaged" location to allow drum 93 to once again freewheel as the cable 38 is being retracted. It can be appreciated, therefore that extension of the cable 38 involves a series of small extension operations occurring each time clutch disk 200 is rotated away from drum 93, and halting when drum 93 rotates into sandwiching engagement with friction disks 220, ratchet disk 118 and disk 200.

Figure 16:
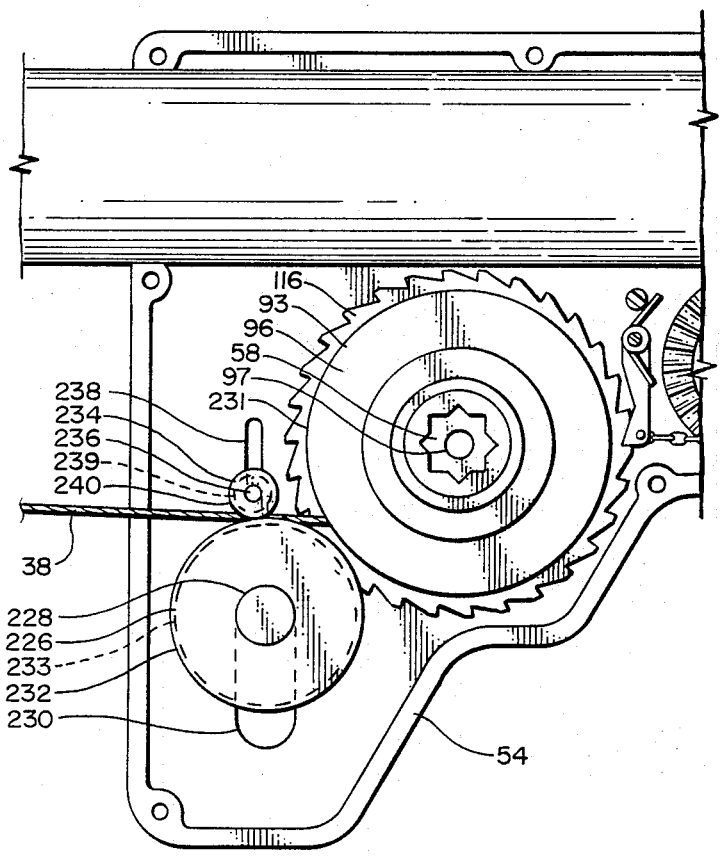
FIG. 16 is a fragmentary side view of an exemplary embodiment of the present invention showing a larger and a smaller roller urged into opposing engagement with the cable to assist in extending the cable from the drum.

It is sometimes desirable to extend the cable 38 by rotation of the drum 38 when no load is attached to the end of the cable. The absence of a load can sometimes result in the cable 38 unwinding about drum 93 when drum 93 is rotated in the unwinding direction without any significant extension of cable 38. Therefore, in order to extend cable 38 from drum 93 around support roller 100 and through sleeves 41, 42, 44 when there is no load attached to cable 38 and as best shown in the exemplary embodiment of the present invention depicted in FIG. 16, the illustrative retraction and extension means 52 includes a friction roller 226 rotatably mounted about a shaft 228. Shaft 228 is oriented in a direction generally parallel to drive shafts 57, 57' and is located generally downward and inward of shafts 57, 57'. A pair of elongated races 230, attached to opposing sidewalls 56 of housing 54 in a generally vertical direction, support shaft 228 at opposite ends thereof. Roller 226 is biased in a generally upward direction within races 230 by a spring (not shown) connected to shaft 228 and sidewall 56 so that an outer edge 230 of drum flange 96 frictionally engages an outer edge 232 of roller 226. Therefore when drum 93 is driven in a clockwise direction as viewed in FIG. 16, friction roller 226 is driven in a counterclockwise direction by frictional contact with drum 93.

Roller 226 includes a grooved circumferential channel surface 233 which is biased into frictional engagement with the cable 38. Opposite roller 226 is another friction roller 234 rotatably mounted on a shaft 236 which is oriented generally parallel to shaft 228 and which is supported in a pair of opposing elongated races 238 attached to opposing sidewalls 56 of housing 54 and in a generally vertical direction above races 230. Roller 234 is biased in a generally downward direction within races 238 toward roller 226 so that a grooved circumferential channel surface 239 about roller 234 frictionally engages cable 38 to sandwich cable 38 between rollers 226 and 234. Roller 234 includes an outer circumferential edge 240, which is biased into frictional engagement with outer edge 232 of roller 226 so that when roller 226 is driven in a clockwise direction by drum 93, roller 226 drives roller 234 in a counterclockwise direction.

In carrying out the present invention, the diameter of friction roller 226 is larger than the diameter of drum side flanges 96 so that the diameter of friction roller 226 is always larger than the combined diameter of hub 94 and the cable wound around hub 94. This arrangement causes the grooved circumferential channel surface 233 to rotate through a greater arcuate distance and therefore a greater angular velocity than the outermost layer of wound cable around hub 94 so that during no load extension, rollers 226, 234 pull cable 38 from drum 93 and feed cable 38 around support roller 100 and through sleeves 41, 42, and 44.

Overall operation of the exemplary relocating apparatus of the present invention 20 proceeds as described hereinbelow. An operator: (i) retrieves the relocation apparatus 20 from any convenient stowed location; (ii) carries the apparatus 20 to mast 22; (iii) retracts plunger 170; (iv) inserts U-shaped member 58 within the mast bracket 162; and (v), then releases plunger 170. Thumb wheel 178 is then rotated so that the lower surface of flange 160 and the upper surface of thumb wheel 178 engage respective opposing surfaces of flange 162. Mainsail halyard 30 is then secured within opening 188 of fitting 49, and the pawl 114 is released by pulling ring 126 to allow cable 38 to be extended and then engaged about dinghy bridle pulley 51. In the event the relocating apparatus 20 does not reach bridle pulley 51 because the distance between mast 22 and dinghy 34 is too great, sleeve 44 is extended by manually compressing button tips 148 and manually pulling sleeve 44 outwardly until button tips 148 extend through the vertical openings in sleeve 42 at the selected extension distance. Mainsail halyard 30 is extended so that sleeves 41, 42, 44 are approximately horizontal to deck 32. The cable loop 52 on cable 38 is then engaged within fitting 49 and winch handle 61 is inserted within socket 59. As the winch handle 62 is rotated by the operator in a clockwise direction, dinghy 34 is raised above cabin overhead 39. The operator then pivots the relocating apparatus 20 so that the dinghy 34 is swung outboard of deck edge 25. The operator then inserts the winch handle 61 into socket 60 and rotates the handle 61 in a clockwise direction to extend sleeves 42/44 axially outward beyond deck edge 25. The operator then reinserts the handle 61 into the socket 59 and rotates the handle 61 in a counterclockwise direction to extend cable 38 and lower dinghy 34 into the water. Retrieval of the dinghy 34 from the water for stowage onto the cabin overhead 39 is accomplished by reversing the order of the aforementioned steps.

Other embodiments not disclosed herein, but which are encompassed within the spirit and scope of the present invention as described herein are also included as part of the present application. For example, if flange 162 is attached to an aft surface of mast 22, the exemplary relocating apparatus 20 may be used for extending and retracting a mainsail clew along a mainsail boom track simply by extension and retraction of sleeve 42 as described previously. Other exemplary applications of the present invention include (i) supporting a boatswain chair or the like over the side of a boat to support an individual working on the hull, and (ii) raising and lowering fishing apparatus such as crab pots, nets or the like between the boat and the water. On the other hand, the present invention is also applicable to other domestic and industrial uses where heavy loads must be relocated without the benefit of a source of electrical power or the like.

What is claimed is:

1. An apparatus for shifting a load between spaced positions, said apparatus comprising, in combination:

(a) a support beam having a plurality of telescopically oriented tubular sleeve portions of progressively smaller diameter;

(b) a vertical support member;

(c) first means for coupling one end of the largest diameter one of said plurality of telescopically oriented tubular sleeve portions to said vertical support member at a first location thereon with freedom for pivotal movement about a vertical axis;

(d) cable support drum means mounted on said support beam, said cable support drum means having a cable secured at one end to said support drum means and wound thereabout with the opposite free end of said cable passing through said plurality of telescopically oriented tubular sleeve portions and exiting therefrom through one end of the smallest diameter one of said tubular sleeve portions, said free opposite end of said cable including means for separably attaching said cable to the load to be shifted;

(e) means for shifting said plurality of telescopically oriented tubular sleeve portions axially relative to one another so as to selectively elongate and shorten said support beam, said means for shifting said plurality of telescopically oriented tubular sleeve portions including:

(i) a toothed rack secured to the outer surface of, and extending axially along, one of the smaller diameter tubular sleeve portions;

(ii) a worm gear mounted on the free end of the next larger tubular sleeve portion and drivingly coupled to said toothed rack;

(iii) a circular rack mounted on said support beam, said circular rack having a socket for receiving a removable winch handle;

(iv) a pinion gear meshed with said circular rack;

(v) a drive shaft drivingly connected at one end to said worm gear and at its other end to said pinion gear so that upon insertion of a winch handle into said socket and rotation thereof said smaller diameter tubular sleeve portion is caused to move axially relative to said next larger tubular sleeve portion so as to elongate or shorten said support beam;

(vi) a plurality of latch openings formed axially along the length of one of said tubular sleeve portions; and, (vii) at least one outwardly biased depressible latch button formed on the next smaller diameter one of said telescopically oriented tubular sleeve portions so that said next smaller diameter one of said telescopically oriented tubular sleeve portions can be shifted axially relative to the immediately adjacent outer one of said tubular sleeve portions by depressing said outwardly biased button inwardly through one of said openings and shifting said next smaller diameter tubular sleeve portion axially relative to the next adjacent outer tubular sleeve portion until said outwardly biased button snaps into a different latch opening on said adjacent outer tubular sleeve portion;

(f) second means coupled to said one end of said smaller diameter one of said tubular sleeve portions of said support beam for coupling said support beam to said vertical support for pivotal movement about a horizontal axis, said second coupling means being vertically spaced from said first coupling means so that said support beam can be maintained in a substantially horizontal plane at all operative lengths and pivotal positions about said vertical axis; and, (g) means for controllably unwinding and winding said cable about said cable support drum means so as to permit the operator of said apparatus to shift a load between spaced positions.

2. An apparatus as set forth in claim 1 wherein said vertical support member comprises a mast on a sailing vessel.

3. An apparatus as set forth in claim 1 wherein said vertical support member comprises a mast on a sailing vessel, said load comprises a dinghy, and said support beam is movable between a first position wherein said dinghy is stowed on board said sailing vessel and a second deployed position outboard of said vessel for permitting said dinghy to be lowered into and/or lifted out of the water.

4. An apparatus as set forth in claim 1 wherein said cable support drum means include:

(i) an engagable/disengagable unidirectional ratcheting mechanism normally biased into the engaged position for preventing unintentional unwinding of said cable when supporting a load; and (ii) a first socket for receiving a removable winch handle for enabling manual rotation of said cable support drum means during winding and unwinding of said cable.

5. An apparatus as set forth in claim 3 wherein said cable support drum means further includes a clutch assembly for disengaging said drum from said unidirectional ratcheting mechanism during manual unwinding of said cable.

* * * * *

UNITED STATES PATENT AND TRADEMARK OFFICE

CERTIFICATE OF CORRECTION

PATENT NO. : 4,957,207

DATED : September 18, 1990

INVENTOR(S) : Barclay L. Thomas

It is certified that error appears in the above-identified patent and that said Letters Patent is hereby corrected as shown below:

Title page, Item [54], Change "NATERO" in title to--WATER-- and,

Col. 1, line 2, Change "NATERO" in title to--WATER--.

Signed and Sealed this

Fifteenth Day of December, 1992

*Attest:*

DOUGLAS B. COMER

*Attesting Officer*

*Acting Commissioner of Patents and Trademarks*